US008667921B2

(12) United States Patent
Nielsen

(10) Patent No.: US 8,667,921 B2
(45) **Date of Patent: *Mar. 11, 2014**

(54) COUPLING

(75) Inventor: Bent Nielsen, Brøndby (DK)

(73) Assignee: Nadiro A/S, Svendborg (DK)

( * ) Notice: Subject to any disclaimer, the term of this patent is extended or adjusted under 35 U.S.C. 154(b) by 103 days.

This patent is subject to a terminal disclaimer.

(21) Appl. No.: 13/378,526

(22) PCT Filed: Nov. 2, 2009

(86) PCT No.: PCT/EP2009/064462

§ 371 (c)(1),
(2), (4) Date: Feb. 7, 2012

(87) PCT Pub. No.: WO2010/145721

PCT Pub. Date: Dec. 23, 2010

(65) Prior Publication Data

US 2012/0125252 A1 May 24, 2012

(30) Foreign Application Priority Data

Jun. 15, 2009 (WO) ..... PCT/EP2009/057367

(51) Int. Cl.
*B63B 23/00* (2006.01)

(52) U.S. Cl.
USPC ..... 114/377; 114/365

(58) Field of Classification Search
USPC ..... 114/365, 377, 378, 380
See application file for complete search history.

(56) References Cited

U.S. PATENT DOCUMENTS

| | | | | |
|---|---|---|---|---|
| 1,475,617 | A * | 11/1923 | Allbin | 114/380 |
| 1,625,736 | A * | 4/1927 | Menefee | 114/380 |
| 1,925,758 | A * | 9/1933 | Hunt | 114/380 |
| 4,379,579 | A | 4/1983 | Mahan | |
| D392,555 | S | 3/1998 | Glickman et al. | |
| D393,417 | S | 4/1998 | Glickman et al. | |
| D546,735 | S | 7/2007 | Hahne et al. | |
| D561,017 | S | 2/2008 | Carney | |
| D567,071 | S | 4/2008 | Carney | |
| 7,360,498 | B1 | 4/2008 | Mora | |
| D579,759 | S | 11/2008 | Strait et al. | |

(Continued)

FOREIGN PATENT DOCUMENTS

| | | |
|---|---|---|
| FR | 87 561 | 12/1966 |
| GB | 3305 | 0/1914 |

(Continued)

OTHER PUBLICATIONS

U.S. Coast Guard, "Potential Serious Safety Hazard Norsafe Camsafe Lifeboat Release Mechanisms," Jan. 27, 2004.

(Continued)

*Primary Examiner* — Lars A Olson
(74) *Attorney, Agent, or Firm* — Brinks Gilson & Lione

(57) ABSTRACT

A coupling for coupling a fall (26) to a lifeboat (1) comprising locking portions and a receiving portion constituting a hollow (10) having a open end and an upwardly facing aperture (15). The locking portion (25), hollow (10) and aperture (15) having a form preventing the locking portion (25) from passing through the aperture (15). The coupling further comprises actuators (30, 35, 39) controlled by a controller (40). A string (27) may be provided for easy retrieval of the locking portions upon the retrieval of the lifeboat (1).

21 Claims, 5 Drawing Sheets

(56) References Cited

U.S. PATENT DOCUMENTS

| | | | |
|---|---|---|---|
| 7,726,618 | B2 | 6/2010 | Pedemonte |
| 7,993,069 | B2 | 8/2011 | Persson |
| D649,028 | S | 11/2011 | Nielsen |
| 8,061,920 | B2 | 11/2011 | Wimberley |
| 2003/0098401 | A1 | 5/2003 | Carnevali |
| 2008/0286477 | A1 | 11/2008 | Hattori |

FOREIGN PATENT DOCUMENTS

| | | | |
|---|---|---|---|
| GB | 27179 | | 0/1911 |
| GB | 695072 | | 8/1953 |
| GB | 2 150 903 | | 7/1985 |
| JP | 60142193 | A | 7/1985 |
| JP | 10017263 | | 1/1998 |
| JP | 2005 212534 | | 11/2005 |
| JP | 2007 160955 | A2 | 6/2007 |
| KR | 2019980016137 | | 6/1998 |
| KR | D3020110033636 | | 8/2011 |

OTHER PUBLICATIONS

PCT International Search Report for related International Application No. PCT/EP2009/064462, dated Dec. 23, 2011.

PCT International Preliminary Report on Patentability for related International Application No. PCT/EP2009/064462, dated Dec. 15, 2011.

PCT Written Opinion for related International Application No. PCT/EP2009/064462, dated Dec. 15, 2011.

Korean Office Action for Korean Design Appl. No. 30-2010-8474, Jun. 2, 2011.

Korean Office Action for Korean Appl. No. 30-2011-33637, Jul. 13, 2012.

* cited by examiner

COUPLING

RELATED APPLICATIONS

This application claims the benefit under 35 U.S.C. §371 of International Patent Application No. PCT/EP2009/064462, with an international filing date of Nov. 2, 2009, which claims priority to PCT/EP2009/057367, filed Jun. 15, 2009, the contents of all of which are incorporated herein by reference in their entirety.

The present invention relates to a coupling suitable for handling of loads such as lifesaving equipment.

The invention may be applied to launching systems for lifeboats that are either to be lowered to the surface of the sea from vessels or rigs and the like or to lifeboats of the free fall type which under launch are free falling from vessels or rigs and the like to the surface of the sea.

The invention may also be applied to general lifting applications such as cargo handling by means of a crane and the like.

According to one aspect, the present invention relates to a coupling for coupling a fall or a structure to a lifeboat. The coupling inter alia comprising a load bearing locking portion adapted to be joined with a fall or a structure and a receiving portion prepared for being attached to, or unified with, a lifeboat.

The receiving portion comprises a hollow having an open end and being adapted to receive the locking portion. An aperture is provided in the wall of the hollow allowing the locking portion to connect with a fall or a structure through the aperture.

It is understood that the expressions ship, boat or vessel, throughout this specification, are meant to denote any kind of floating structure suitable for carrying either persons, cargo or a combination thereof.

It is further understood that the expression fall, throughout this specification, is meant to denote any kind of wire or rope which is capable of being wound up on, or wound from, a drum.

BACKGROUND

In adverse weather conditions, safe launch of a lifeboat from a stationary structure or a ship, which may or may not be making way, requires an expertise which few mariners possess. Launch exercises are seldom able to simulate realistic conditions as few masters are prepared to risk lives and lifeboats etc. in heavy weather conditions in order to facilitate the acquisition of skills required in the event of an emergency only.

Accidents during mandatory lifeboat drills are an ongoing issue in discussions relating to safety of seafarers.

Lifeboats are, under exercises as well as under emergencies necessitating that the crew abandon the structure or ship, either controllably lowered into the sea while carrying crew, or released, and thereby freefalling, into the sea, also while carrying crew.

Today, most lifeboat accidents are associated with on-load release functions incl. malfunctions of lifeboat hooks. On-load release involves releasing the lifeboat from its falls while the lifeboat is at least partially suspended by the falls.

The ability to on-load release a lifeboat is mandatory under IMO regulations for all ships built after Jun. 1, 1986. Ships built before this date is generally provided only with off-load release hooks, which cannot be released from its falls unless the lifeboat is fully supported by the sea.

The number of accidents and the number of people killed or injured during test or trial launches as well as launches under emergencies of lifeboats runs into the hundreds, however, there are no official records available disclosing the total number fatalities or injuries. Ship owners, operators, P&I Clubs, class societies and various other international organizations etc. are now, as a consequence, focussing on reducing the number of accidents.

In order to comply with present IMO requirements, hooks suspending lifeboats are required to have off-load release capability as well as on-load release capability.

Accidents with on-load release hooks are found to occur due to lack of maintenance, lack of knowledge in operating the hooks as well poor design, and further, it has, for various reasons, proved difficult to design and setup sufficient measures against the effects of poor maintenance and human error.

Another cause of accidents is difficulties in ensuring that, when the lifeboat is provided with two or more falls, the falls are released simultaneously from the hooks. Simultaneous release may require local release of the falls by two or more crewmembers working at opposite ends of the boat. Experience has shown that, all too often, the boat's crew has managed to release one hook only, leaving the boat suspended from the other still connected fall. In the next wave trough, the boat is upended, tipping its occupants into the water or around in the cabin of the lifeboat, with potentially serious consequences. Recognition of this problem by lifeboat manufacturers and maritime authorities, together with the introduction of partially and totally enclosed lifeboats, has led to the development of more sophisticated lifeboat release systems being able to release both falls simultaneously from a single control position, however the systems are still based on conventional hook system, wherein the at least one hook is rigidly mounted to an upwardly facing portion of the lifeboat.

Today's lifeboats of the type which are to be lowered to the surface of the sea are typically provided with one hook forward and one hook aft. The hooks are operated by release means adapted to release both hooks simultaneously as soon as the lifeboat is waterborne.

A typical embodiment consists of, as already mentioned above, two releasing hooks, one hook arranged in each end of the lifeboat and interconnected by a chain or rod running from a hook arranged at one end of the lifeboat to a hook arranged at the opposite end of the lifeboat. The chain or rod arranged between the two hooks is equipped with an operating grip arranged in a convenient location. The chain or rod is fastened to the releasing hooks in such a manner that pulling a chain or similar will cause the hooks to upset and thus free themselves from the falls. Releasing hooks interconnected by a rod, possibly arranged along the floor of the lifeboat, are operated by means of a lever acting through universal joints or similar.

Different release systems necessitate special training of the crew operating the lifeboats in order to ensure that the operators are familiar with the hook release system installed in the lifeboat at the particular vessel or rig.

Further, P&I Clubs, class societies and various other international organizations recommend that old hook systems, which are not capable of on-load release, are replaced with new hooks of improved design.

Most of the prior art hook designs are intentionally inherently unstable as the weight of the boat suspended from the hooks results in a hook opening effect, which has to be withstand by dedicated arrangements in the hooks operating mechanism.

BACKGROUND ART

Today, there are various hook systems available, one common system is the SAFELAUNCH© lifeboat release hook which is a quick release on-load hook that is designed to allow launch of conventional davit launched lifeboats. The hook incorporates various moving parts, and requires regular maintenance.

The Danish patent application PA 2008 00829 teaches a coupling for coupling a fall to a lifeboat. The coupling comprises a locking portion and a receiving portion. The receiving portion constitutes a hollow having an open end and an upwardly facing aperture. The locking portion, hollow and aperture are configured such that the locking portion is prevented from passing through the aperture. The coupling further comprises actuators, controlled by a controller, for maintaining the locking portion within the hollow as well as releasing the coupling by forcing the locking portion out of the hollow.

The U.S. Pat. No. 7,360,498 B2 teaches a hook for a lifeboat launching system with a more simple design, however the suggested hook design still encompass various more or less delicate moving parts. The patent further disclose a system for supporting and releasing a twin fall lifeboat comprising a pair of hooks releasable engaged with a corresponding pair of lifting links arranged forward and aft on the lifeboat. The hooks provide positive locking under load because of a load over centre design, wherein the load is in line with the centre of the hook rotation, and thereby preventing the hook from opening inadvertently and eliminating the need for a hydrostatic device. The system incorporates a release handle, a release arm, a weighted rack and a pair of flexible cables attached at first ends to the rack and attached at second ends to the hooks. The release handle is attached to the release arm at a pivot point. The release arm includes a wheel disposed within a wheel encasement attached to the weighted rack. The system is capable of assuming an engaged configuration in which the lifting links are secured by the hooks and, upon the release handle being pulled by an operator, rotating the release arm about a boss and thereby lifting the weighted rack and pulling the flexible cables releasing the lifting links from the hooks substantially simultaneously.

There has been made various attempts to create alternative and simple release systems, some of which are briefly discussed below:

GB 695072 A discloses a boat tackle engage and release system. The system comprises bars adapted to receive a hook in a space arranged within the bars. Sliding pins engage holes within the bars in order to provide a bridge intersecting the space arranged within the bars. The pins secure the hooks within the space, and the boat is released from the hooks upon the pins being retracted from the space by means of pendulum loaded lever.

GB 191303305 A discloses disengaging gear for disengaging a lifeboat from falls suspending the lifeboat above the water. A support is attached to a running block of the falls which contains a spring-loaded bolt engaging a ring attached to the lifeboat. Upon the lifeboat being waterborne, a ring is inserted in a transverse slot and the bolt is automatically withdrawn, thus releasing the lifeboat from the suspending falls.

JP 10017263 A2 discloses a lifeboat suspension device adapted to suspend a lifeboat by means of a wire dispatched from a mother ship. The lifeboat is coupled to the wire, via a locking part arranged on the wire, to a hollow provided on the boat. The locking part, which is suspended by the wire, is introduced into the hollow via an opening and the boat may be disconnected from the wire by means of changing the form of the receiving hollow, e.g. via levers etc.

JP 2007160955 A2 discloses a hook device capable of releasing a connector from a boat. The hook, which comprises two substantially symmetrical parts, connects a connector to a connection base on the boat, and holds the connector within a space provided within the hook parts. Upon disengagement of the connector, the hooks open and the connector may be retracted whereby the boat is free.

GB 191027179 A (GB27179) discloses an off-load lifeboat release system comprising a socket member and a headed hanger attached to the falls suspending a lifeboat. The hanger is received by the socket member in order to secure the lifeboat. The socket is adapted to, by means of various movable parts, rotate in order to eject the hanger when the boat is waterborne. The load imposed on the system by the suspended lifeboat is, via the hanger, carried by the socket member.

JP 2005212534 A discloses a boat hook device including a dome fixed to the boat. The hook is fixed to a wire and is tilt ably housed in the dome. A tilting stopper is provided in the dome in order to prevent detachment of the hook. The hook according to the disclosure is an approximate disc having an approximate spherical shaped convex surface, and is equipped with a dome having approximate spherical shape concave surface. A hook locking window is provided through which the hook can not pass and the wire rope enter forcibly. A hook passing window is further provided where the hook can pass.

Several of the abovementioned disclosures teach on-load release systems which rely on, in order to release the boat while the coupling is under load, the boat's weight, i.e. the vertical forces applied to the hook from the boat, in order to release the coupling. This on-load release feature may lead to the coupling systems potentially releasing accidentally while the boat is intentionally suspended from the falls, leading to life threatening situations for the occupants of the lifeboat.

BRIEF DESCRIPTION OF THE INVENTION

The present invention seeks to improve the performance and reliability of couplings for lifesaving equipment.

Up to this day, prior art has failed to teach a simple and yet reliable and inexpensive coupling system which in a safe and reliable manner, without substantially increasing the weight and/or particulars of the system, provides a reliable and durable coupling system minimizing any risk of injuries to crew as well as damages to the equipment resulting from mechanical failure of the coupling system.

According to the invention, there is provided an improved coupling as per the introductory part of this specification, and in particular upon configuring the coupling such that that the coupling further comprise a pawl arranged near the open end of the hollow, an on-load releasable coupling encompassing significantly fewer moving parts, while still being very efficient and reliable, is provided.

Further, the coupling system according to the present invention inter alia relies on application of forces oriented substantially normal to the forces taken up by the falls, in order to release the boat from its falls. The horizontal forces are established by a sequence of specific actions, which after completion only, allows the locking portion to decouple from the receiving portion.

The pawl is configured such that the pawl allows the locking portion to enter the hollow and, upon entrance of the locking portion into the hollow, prevent the locking portion from exiting the hollow. The coupling incl. pawl may, in a preferred embodiment, be configured such that the pawl is able to, in twin fall applications, hold the weight of the complete boat incl. load in one end of the boat only, whereby, in case one coupling accidentally releases or fails, the other coupling will be able to hold the boat until it is finally lowered into the water.

The simple design of the coupling requires only very little maintenance, and any risk of components necessitated by the prior art hook designs failing due to rust and the like are virtually eliminated.

According to one embodiment, the coupling further comprises means for, in order to release the coupling, force the locking portion out of the hollow. The means for forcing the locking portion out of the hollow inter alia constitute an actuator arranged opposite the open end of the hollow and configured such that the actuator, upon activation, apply a substantially linear force onto the locking portion in a direction oriented outwards of the hollow.

According to one embodiment, the actuator, by means of interconnection, change a position of the pawl, such that the locking portion is allowed to exit the hollow.

According to one embodiment, the pawl is rotatable about an axis whereby the pawl, as a result of rotation, permits the locking portion to enter the hollow.

According to one embodiment, the pawl is rotated through an arrangement inter alia comprising a glider configured for transferring a linear motion, established by the actuator, from the actuator to the pawl, such that, upon actuation of the actuator, the pawl is rotated about the axis and into a position where the locking portion may exit the hollow.

According to one embodiment, the glider constitutes an angular part with a first flange connected to the actuator and a second flange abutting the pawl.

According to one embodiment, the locking portion is, upon receipt of the locking portion into the hollow, accommodated within the flanges of the glider.

According to one embodiment, the actuator is provided with a return spring.

According to one embodiment, the actuator is hydraulically operated.

According to one embodiment, the coupling comprises a second actuator.

According to one embodiment, the locking portion constitutes a ball-like member.

According to one embodiment, the coupling further comprises at least one string connected to the locking portion allowing easy retrieval of the locking portion into the hollow by pulling the string.

According to one embodiment, the inner sides or surfaces of the hollow constitute an elongated funnel.

According to one embodiment, the walls defining the hollow constitute a load bearing member transferring loads to the load bearing locking portion.

According to one embodiment, the walls defining the hollow having a form preventing the locking portion from passing through the aperture.

According to one embodiment, the hollow constitutes a rigid structure with fixed walls ensuring that the width of the aperture is substantially permanent.

According to one embodiment, at least a part of the surface of the locking portion is provided with friction reducing means such as Teflon, PE or equivalent.

According to one embodiment, the hollow, on at least on a part of its internal surfaces, is provided with friction reducing means.

According to one embodiment, the coupling constitutes an on-load release coupling configured such that the locking portion may be released from the receiving portion while the walls of the receiving portion transfers about 50% or more of the weight of a lifeboat suspended by a fall connected to the locking portion. In particular, the coupling according to this embodiment is provided with one or more actuators being able to apply a linear force onto the locking portion having a magnitude being sufficient to overcome frictional forces generated in between the surface of the locking portion and the surface of the hollow accommodating the locking portion such that the locking portion will be forced out of the hollow.

According to one embodiment, a lifeboat is provided where the lifeboat comprising a coupling according to the present invention.

According to one embodiment, the lifeboat comprise two opposed receiving portions, one being arranged forward of the lifeboat with the open end oriented forward with respect to the lifeboat and one being arranged aft of the lifeboat, with the open end oriented aft with respect to the lifeboat.

According to one embodiment, the lifeboat incl. receiving portion is configured such that the apertures are upwardly oriented with respect to the lifeboat.

According to one embodiment, the coupling is retrofitted onto the lifeboat.

According to one embodiment, the lifeboat is a freefall lifeboat.

According to one embodiment, a lifeboat coupling system comprising a coupling according to the present invention is provided.

DETAILED DESCRIPTION WITH REFERENCE TO THE FIGURES

Figure 1:
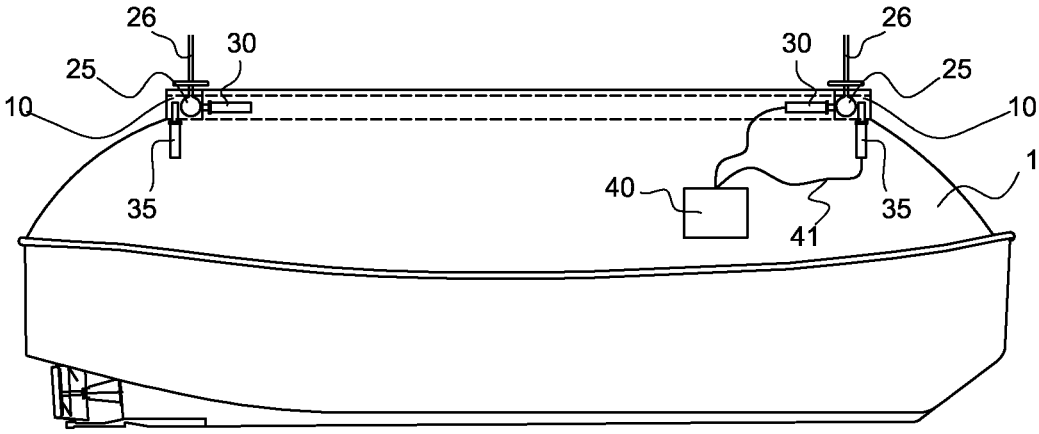
FIG. 1 is a side view of a lifeboat suspended from falls.

FIG. 1 shows a lifeboat 1 suspended by falls 26 via couplings provided in the lifeboats 1 forward and aft ends. A lifeboat suspended according to FIG. 1 is generally called a twin fall lifeboat. The falls 26 may be discharged from one or more winches (not shown) or similar devices arranged on board a vessel or on a rig. In the opposite ends of the falls 26, the falls 26 are provided with locking portions 25. The locking portions 25 are firmly connected to the falls 26, either directly or indirectly, and further, as the locking portions 25 transfers the weight of the lifeboat 1 incl. crew etc. to the falls 26, the strength of the connections between the falls 26 and the locking portions 25 is important for the reliability of the system. Failure of the connections may result in the lifeboat 1 freefalling to the sea surface which obviously may lead to serious injuries to the crew as well as damages to the equipment.

The locking portion 25 may advantageously form an integrated part with the fall 26; however this is in no way a requirement for the coupling according to the present invention.

Figure 10:
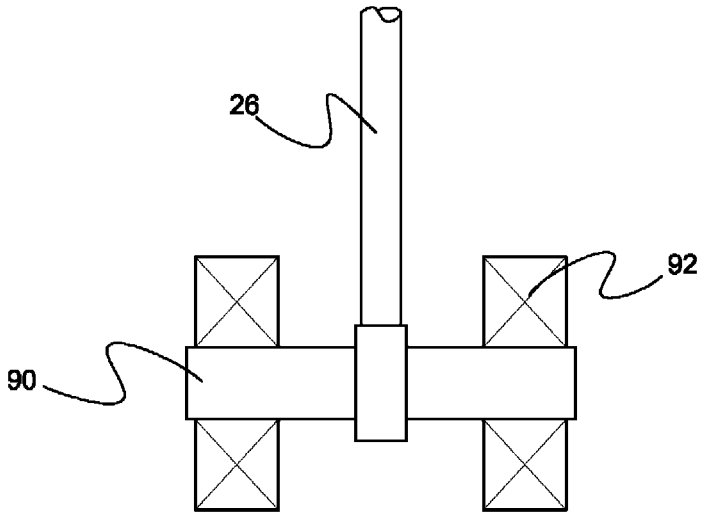
FIG. 10 illustrates an embodiment of a locking portion.

The locking portion 25 is in some of the figures shown as a spherical ball; however the locking portion 25 may equally take any alternative form, e.g. a semi-sphere, cylindrical, pyramidal or cubic form etc. Further, the locking portion may constitute e.g. a ball with flattened portions (FIG. 7) or a transverse shaft comprising bearings or rollers etc (FIG. 10).

The locking portions 25 are in FIG. 1 received within hollows 10 provided on the lifeboat 1. The hollows 10 have a cross-sectional shape allowing for loose fit with the locking portions 25. The hollows 10 may, according to various embodiments, comprise a number of holes for actuators and the like.

The hollows 10 may constitute elongated hollows 10 oriented substantially in the sailing direction of the lifeboat 1; however the hollows may equally be arranged at an angle to the forward sailing direction of the lifeboat 1.

Figure 3:
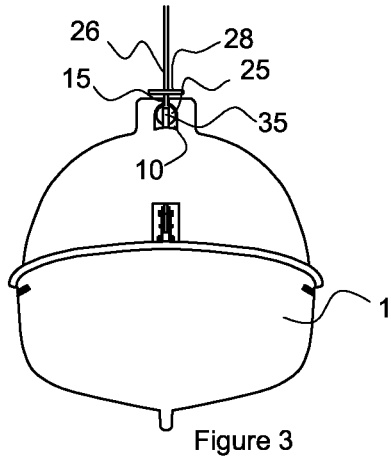
FIG. 3 is a front view of a lifeboat suspended from falls.
Figure 4:
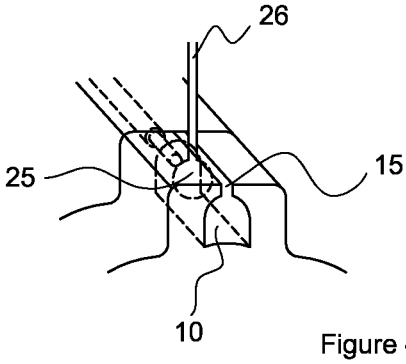
FIG. 4 is a perspective view of a coupling.

As can be seen in FIGS. 3 and 4, the hollow 10 further comprise an aperture 15, which according to the shown embodiment; constitute an upwardly facing aperture 15. Further, the aperture 15 is oriented substantially according to the hollow 10 and having a free width which on one hand provide a clearance between the fall 26, or an intermediate component like a handle or any other interposed part between the locking portion 25 and the fall 26, and the side faces of the aperture 15, while on the other hand, the width of the aperture 15 is selected such that the locking portion 25 is prevented from passing through the aperture 15.

According to the embodiment depicted in the FIGS. 1-5, actuators 30, 35, forming part of a release system, are arranged in the vicinity of the hollow 10, and the actuators 30, 35 may constitute any suitable means for inflicting an actuation or movement. According to the illustrated embodiment, the means for actuation constitute electrical actuators 30, 35; however the actuators may equally constitute hydraulically operated actuators or equivalent. Further, the actuators 30, 35 are not necessarily operated by means of external power meaning that the actuators may constitute hand or spring operated actuators, interconnected or not, and operated via linkages which may be push-pull rods, chains or wires etc.

The release system may be equipped with auxiliary or backup systems (not shown) which could constitute parallel systems. A parallel system may be a complete and independent system; however a backup system may also constitute only selected parts of the release system, i.e. that the backup system may rely on one or more parts of the main release system.

According to FIG. 1, the actuator 30, which is oriented substantially horizontal, is adapted to, upon activation; force the locking portion 25 towards the open end of the hollow 10, and the actuator 35, which is oriented substantially vertical, is adapted to, upon activation, allow the locking portion 25 to enter or exit the hollow 10.

The actuator 30 must be able to overcome the frictional forces developed between the locking portion 25 and the hollow 10 and aperture 15 respectively. The forces may be substantial as the weight of the lifeboat 1 incl. the crew is transferred to the fall 26 via the contact surface between the locking portion 25 and the hollow 10 and aperture 15 respectively. In embodiments wherein the lifeboat 1 is suspended from two falls 26, the weight to be transferred to one fall 26 makes up approximately 50% of the total weight of the lifeboat 1 incl. crew.

The hollow 10 incl. the aperture 15, the fall 26 and the locking portion 25 may be provided with friction reducing means such as low friction coatings, inserts of Teflon or similar materials, plastic inserts or coatings or even bearing means.

In the embodiment according to FIG. 1, the actuators 30, 35 are depicted in their de-activated states, meaning that the actuator 30 is retracted allowing the locking portion 25 to rest within the hollow 10, while the actuator 35 is extended and thereby preventing the locking portion 25 from exiting the hollow 10 whereby the coupling is disengaged and the lifeboat 1 freed from the fall 26.

In the illustrated embodiment, the actuators 30, 35 are selected such that the resting position of the actuators 30, 35 are according to FIG. 1, i.e. the actuator 30 rests in a retracted position, and the actuator 35 rests in an extended position.

The hollow 10 incl. the aperture 15 and actuators 30, 35 constitutes a receiving portion. The receiving portion may be arranged substantially in the centre of the lifeboat 1 (not shown), near the ends of the lifeboat 1 according to some of the illustrated embodiments, at the end of a lifeboat such as sown in FIG. 9 or at the sides of the lifeboat 1 (not shown).

If the hollow 10 is oriented such that the open end is facing at least partially upwardly, the coupling may release the locking portion 25 even without the assistance from actuators.

Figure 2:
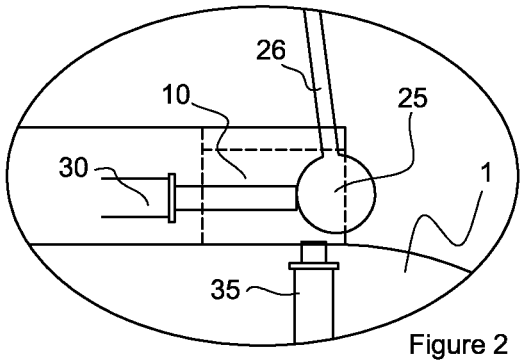
FIG. 2 is an enlarged and partial view substantially according to FIG. 1, however under another scenario.

FIG. 2 illustrates a partial and enlarged view of the coupling immediately before the locking portion 25 is pushed free from the hollow 10. The actuator 30 is close to fully extended while the actuator 35 is retracted.

In the depicted embodiment, the hollow 10 is shown with substantially parallel inner sides or surfaces. It may, however, be preferred to provide a hollow with non parallel sides, e.g. constructing the hollow 10 with an inner geometry similar a funnel or equivalent, which may reduce the wear on the system as the effects of the relatively sharps edges is reduced. Further, and not shown in this embodiment, the inner surface of the hollow 10 may be provided with a flattened portion adapted to receive a dedicated flattened portion on the locking portion 25. (The flattened portion on the locking portion is not shown in the FIGS. 1-5)

FIG. 3 shows a front view of a lifeboat 1 suspended inter alia by means of one embodiment of the inventive coupling, wherein the locking portion 25 is maintained in the hollow 10 by means of the extended actuator 35. The actuator 35 is illustrated as a rod; however the actuator may equally constitute a gate or a pivoting arm or similar. While the actuator is illustrated as being oriented substantially vertical, this is not in any way essential for the present invention. Other means for retaining the locking portion 25 within the hollow 10, such as springs and the like, may equally be applied.

FIG. 4 is a perspective view of the receiving portion incl. the locking portion 25 situated within the hollow 10. The actuator 35 is not shown in the illustration.

Figure 5:
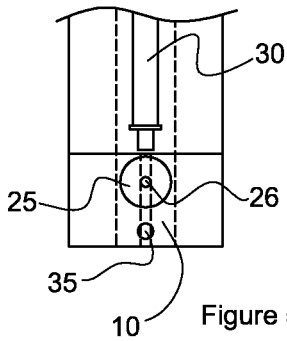
FIG. 5 is a top view of a coupling.

FIG. 5 is a top view of the receiving portion, wherein the locking portion 25 is retained within the hollow 10 by the actuator 35.

Figure 6:
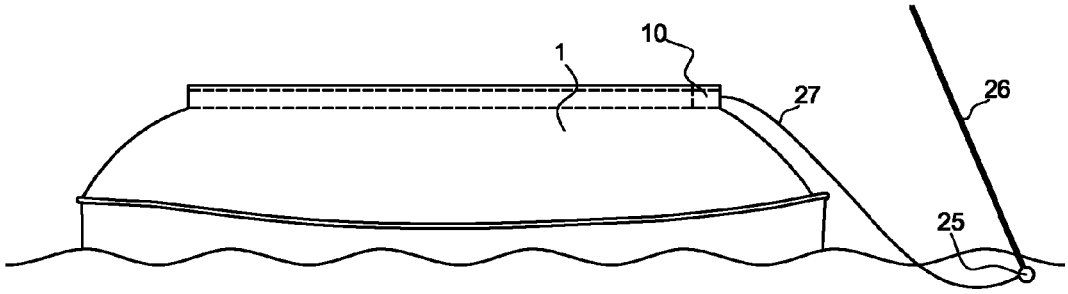
FIG. 6 is a view of a launched lifeboat.

FIG. 6 illustrates the lifeboat 1 in a launched state. According to another aspect of the present invention, upon retrieval of the lifeboat 1, the locking portion 25 may be drawn into the hollow 10 by means of a string 27 (shown in one end of the lifeboat 1 only). The string 27 is in one end connected to the locking portion 25, while the other end is connected to or within the lifeboat 1. The string may be arranged such that the crew, while being within the lifeboat 1, is able pull the string 27 whereby the locking portion 25 is drawn into the hollow 10 facilitating safe and effortless recovery of the lifeboat 1. The string 27 is preferably arranged such that it will be possible to free the lifeboat 1 from the locking portion 25 and string 27 in case of the lifeboat 1 being launched without the intention of recovery. Preferably, the string 27 holds only limited strength.

Figure 7:
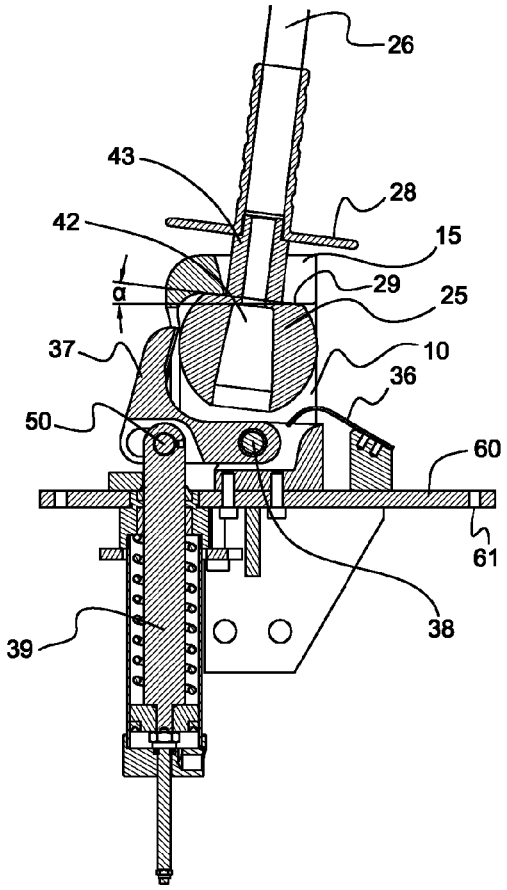
FIG. 7 is a sectional view of through a coupling.

FIG. 7 illustrates another embodiment of a coupling according to the present invention. As can be seen in the figure, an arm 37 pivotally arranged about a centre of rotation or fulcrum 38, and connected to an actuator 39, is adapted to, upon activation of the activator 39, force the locking portion 25 out of the hollow 10 whereby the coupling is disengaged. The actuator 39 may, as can be seen in the figure, be connected to the arm 37 via a displaceable fulcrum 50 whereby the release mechanism may act a lever arm.

The actuator 39 may constitute any kind of actuator such as an electric or hydraulic actuator. The actuator 39 may even constitute a simple form of pure mechanical linkage comprising push-pull rods, chains or cables.

As can be seen in the figure, the upper interior part of the hollow 10 forms an angle α with respect to the base 60, or a plane lying substantially normal to the direction of pull or transfer of force, ensuring that the locking portion 25, when transferring forces to the receiving portion 25 of the coupling, will seek away from the open end of the hollow 10, whereby the structure or layout of the coupling ensures that no unintended decoupling may occur under load. If however the actuator 39 is activated, the locking portion 25 will, in spite of the angled upper part of the hollow 10, still to be forced out of the hollow 10. Further, the upper portion of the hollow 10, in the area close to the aperture 15, may be flattened in order to receive a flattened portion 29 of the locking portion 25.

According to one embodiment, it may be preferred to establish the angle α such that a constitutes an angle of 1.5°-15°, preferably 2-10° and even more preferably 4°-8° with respect to a baseline of the lifeboat 1 or, as an alternative, to a plane lying normal to the direction of vertical movement of the lifeboat under launch and/or retrieval.

In the embodiment according to FIG. 7, the actuator 35 as depicted in the FIGS. 1-5, is superseded by a spring 36. The spring 36, which may constitute a leaf spring, is arranged near the open end of the hollow 10 such that the leaf spring 36 is deflected by the locking portion 25 when the locking portion 25 pass by the open end of the hollow 10. The spring is preferably selected such that the spring is able to withhold the locking portion 25 within the hollow 10 when the fall 26 is slack.

Although the illustrated embodiment suggest a leaf spring, this may not in any way be considered a requirement for the coupling according to the present invention. The shown leaf spring 36 may of course be superseded or replaced by another arrangement demonstrating similar functionality such an arrangement comprising one or more coil springs and the like.

The locking portion 25, or ball, is in the embodiment according to FIG. 7 flattened around a portion of the ball where the fall 26 is connected to the ball, directly or not. Flattening the portion 29, may to some extend lower the stress and load applied to the locking portion 25 as well as the upper portions of the hollow 10 whereby scantlings for the coupling can be reduced and the durability of the coupling increased.

Figure 8:
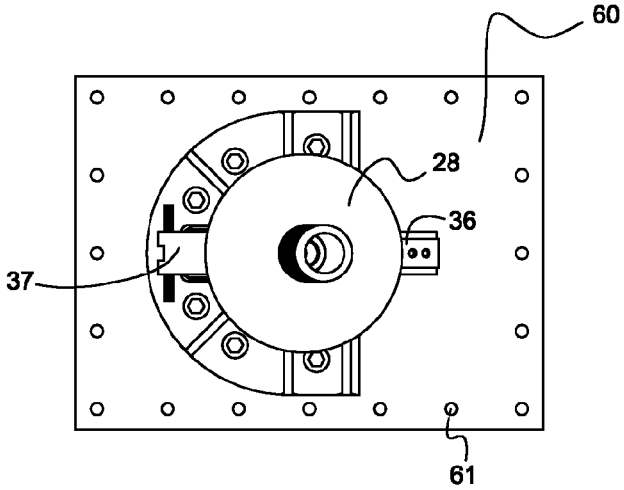
FIG. 8 is a top view of a coupling.

As can be seen in FIG. 8, the locking portion 25 may also be flattened opposite the connection to the fall 26, which in some embodiments will facilitate the design of the receiving portion and the general functionality of the coupling. Further as can be seen, the locking portion 25 may be provided with a hollow or hole 42 which may serve to facilitate joining the locking portion with the fall 26 or any interposed part such as a handle and the like.

Further as can be seen in FIG. 8, the locking portion 25 may comprise a stalk 43 unified with, or interposed between, the locking portion 25 and the fall 26 which, according to the selected embodiment, may improve the overall functionality of the coupling. If the coupling is provided with the shown stalk 42, any wear on the fall 26, due to contact with the aperture 15, will be eliminated and the orientation of locking portion 25 will be controlled by the clearance between the stalk 42 og the aperture 15.

FIG. 8 is a top view of the coupling according to FIG. 7. As can be seen, the receiving portion of the coupling may be provided with means for fixing the base 60 of the receiving portion onto a lifeboat 1 (not shown in FIGS. 7 & 8), further, the base 60 may be attached to a not shown lifeboat by means of bolts, screws or rivets and the like through holes 61, or as an equal alternative, welded onto a structure of a lifeboat 1.

Numeral 28 refers for a collar which may be unified with a handle such as shown e.g. in FIGS. 7 & 8. The collar 28 may facilitate handling of the locking portion 25 and further, according to some embodiments, the collar 28 may prevent the locking portion from dropping in too deep in the hollow 10 through the aperture 15. Finally, the handle and collar may be manufactured from a clearly visible, or luminescent, material or alternatively painted with a paint showing similar properties.

The collar 28 and/or handle may, according to some embodiments, also serve as an intermediate part or component interposed between the fall 26 and the locking portion 28, such as can be seen in FIG. 7.

Figure 9:
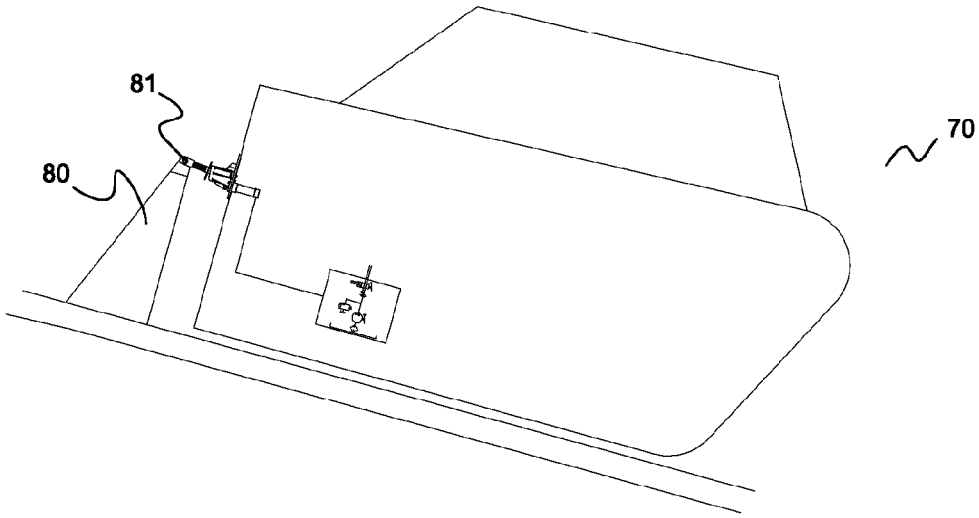
FIG. 9 is a side view of a free fall lifeboat.

FIG. 9 is a side view of a free fall lifeboat provided with a coupling according to one embodiment of the present invention and in particular, according to the FIGS. 7 & 8. As can be seen, the receiving portion of the coupling is connected to, or unified with, a rear portion of the free fall lifeboat and thereby the lifeboat is sustained in the launch facility by means of one coupling only. It will however be possible provide a free fall lifeboat with a plurality of couplings. (not shown)

As free fall lifeboats are not lowered to the sea, falls as per the above exposition, typically suspending the mentioned twin fall lifeboats, are not required for the launch of free fall lifeboats. As a consequence thereof, the locking portion is connected to a structure 80 instead of the falls and possibly via a rod and a pivoting linkage 81.

FIG. 10 illustrates an embodiment of a locking portion where the locking portion inter alia constitutes a rod or shaft 90 oriented substantially normal to the fall 26. In some embodiments, the shaft may be provided with one or more friction reducing bearings 92. As can be seen in FIG. 10, the locking portion may constitute an assembly comprising a shaft 90, oriented transverse to the fall 26, and provided with two bearings which may constitute any form of glide bearings or ball bearings etc.

Figure 11:
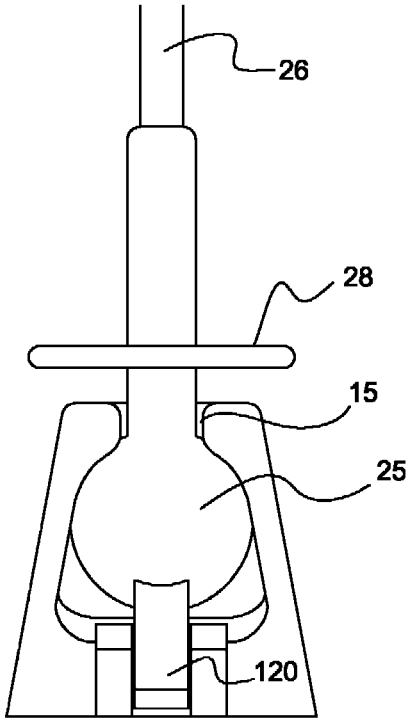
FIG. 11 illustrates a front view of an embodiment a coupling.

FIG. 11 illustrates a front view of an embodiment a coupling which will be discussed in detail with reference to FIG. 12.

Figure 12:
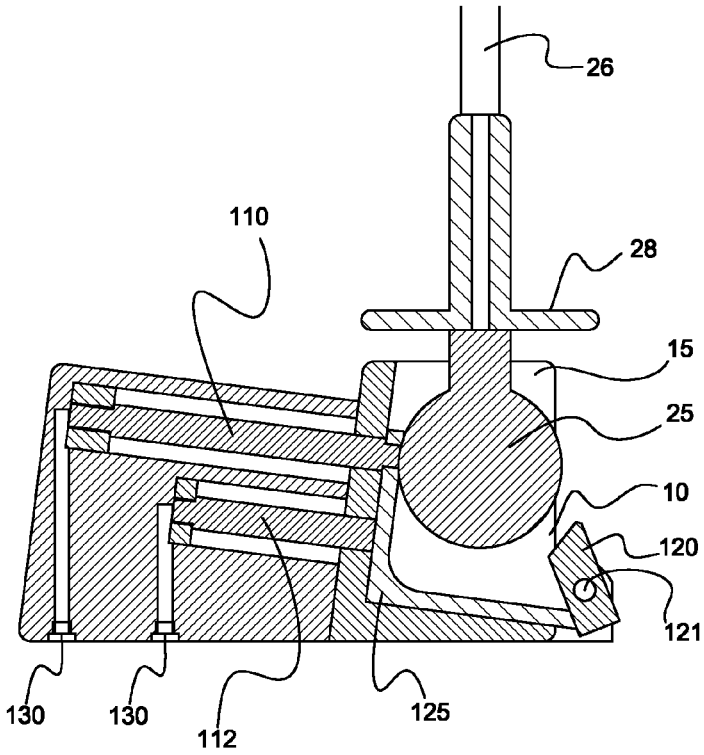
FIG. 12 is a sectional view of through a coupling.

FIG. 12 is a sectional view of through the coupling according to FIG. 11. As can be seen, a pivot able pawl 120 is arranged near the open end of the hollow 10. The pawl 120 may be configured such that the pawl 120 allow the locking portion 25 to enter the hollow 10 and, upon entrance of the locking portion 25 into the hollow 10, prevent the locking portion 25 from exiting the hollow 10.

Although not shown in the figures, the pawl 120 may be provided with springs or equivalent (not shown) in order to ensure that the pawl 120 will assume a substantially upright position after deflection caused by entrance of the locking portion 25.

As can be seen in the figure, an actuator 110, arranged opposite the open end of the hollow 10, may be arranged in order to, upon activation, apply force onto the locking portion 25 in a direction oriented outwards of the hollow 10.

Upon activation of the actuator 110, the position or orientation of the pawl 120 may, by means of interconnection, be changed such that the locking portion 25 is allowed to exit the hollow 10. In the illustrated embodiment, the pawl 120 rotates about an axis 121; however a linear movement of the pawl 120 may equally be established.

The pawl 120 may be rotated through an arrangement inter alia comprising a glider 125. The glider 125 may be configured for transferring a linear motion, established by the actuator 110, from the actuator 110 to the pawl 120, such that, upon actuation of the actuator 110, the pawl 120 is rotated about the axis 121 and into a position where the locking portion 25 may exit the hollow 10.

The glider 125 may constitute an angular part or component, totally or partially housed within the receiving portion, with one flange connected to the actuator 110 and second flange abutting the pawl 120. As can be seen in FIG. 12, the end or tip of second flange of the glider 125 may be angled or processed, and further, depending on the selected embodiment and design, the tip of the pawl 120 may also be angled or phased, such as shown in FIG. 12.

The locking portion 25 may, upon receipt of the locking portion 25 in the hollow 10, be accommodated within the flanges of the glider 125.

The coupling may, depending on the selected embodiment, be provided a second actuator 112. The second actuator 112 may act in combination with the actuator 110, for stability reasons etc., or the second actuator may be provided for redundancy reasons. The actuators 110, 112 may be provided with one or more return springs or equivalent.

The actuators 110, 112 may be hydraulically operated through drilled conduits 130 or equivalent. As can be seen in FIG. 12, the actuators 110, 112 may each be connected to independent conduits, such that redundancy is secured.

Figure 13:
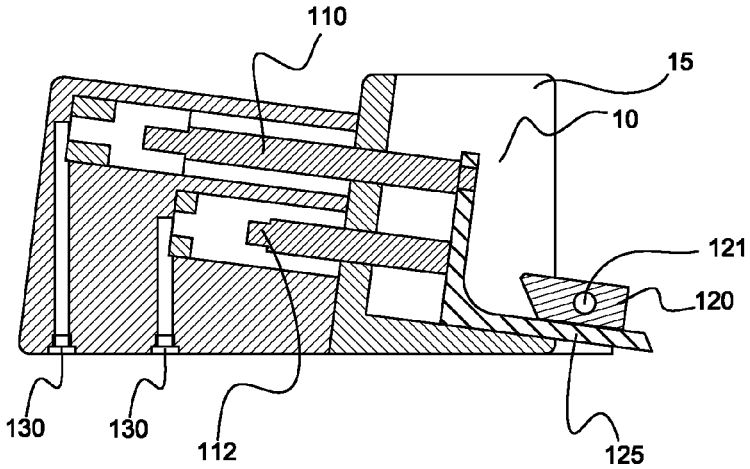
FIG. 13 is a sectional view of through a coupling.

FIG. 13 is a sectional view through the coupling according to the FIGS. 11 and 12, here shown under a scenario wherein the coupling is released. As can be seen, the glider 125 is, by means of the actuators 110, 112, pushed partially our of the hollow 10 whereby the second flange of the glider 125 has rotated the pawl 120 about the axis 121, such that the open end of the hollow 10 allows the not shown locking portion to move out of the receiving portion.

The release system for operating the coupling according to the present invention may be controlled in various ways as already described; however the release system for the coupling according to the present invention also permits electric or electro hydraulic control. As shown on FIG. 1, a controller 40 may be connected to one or more actuators 30, 35, 39 via cables 41. The controller may be connected to a button (not shown) which, upon activation, may cause the controller 40 to initiate a suitable release sequence depending inter alia on the embodiment of the coupling. In embodiments according to FIG. 1-5, the actuator 35 is retracted and the actuator 30 or 39 is extended.

The system may encompass an independent source of power (not shown) rendering a "dead-ship" situation of the mother ship insignificant for the operation and release of the lifeboat 1. The source of power may be any form of battery or equivalent.

The release system according to the present invention may also be controlled by means of, or in a combination with, a hydrostatic release mechanism, wherein the release may be initiated from one or both of an actuator or a transducer to another actuator.

Further, the release system may be operated by hydraulic arrangement which may comprise means for initiating a sequence wherein the actuator 35 is retracted prior to the actuator 30 or 39 forcing out the locking portion 25 from the hollow 10. The hydraulic arrangement may comprise a source of power, possibly including means for holding the system under pressure such as expansion tanks or similar, or the system may be completely hand operated by means of levers etc.

In twin fall lifeboat configurations, and in the event that only one locking portion 25 is forced out of its hollow 10, the system may, depending on the selected embodiment, be partially failsafe as the inclination of the lifeboat 1 causes the hollow holding the stuck locking portion to face upwardly whereby the locking portion 25 is drawn out of the hollow by the weight of the lifeboat.

The release system incl. control etc. may be synchronized in such a way that simultaneously activation of the actuators is achieved, whereby the locking portions 25 is released from the hollows simultaneously. Further, the actuators may preferably be quick acting actuators, which may lessen the impact of the release system operating slightly unsynchronized.

The release mechanism may be operated directly, without power assistance, by means of a number of linkages incorporating push/pull rods, levers and cables. The mechanism may even be constructed with one central actuator operating linkages and/or wires such that the locking portion 25 either is retained within the hollow 10 or forced out of the hollow 10.

The coupling according to the present invention may advantageously be retrofitted to existing lifeboat systems. The retrofit or conversion can be made fairly easily, as the inventive coupling requires only limited reconstruction work or modification of the lifeboat incl. falls.

Although the depicted embodiments suggest the locking portion 25 being configured substantially as a ball where the locking portion 25, under decoupling where load is transferred to the fall, slides within the hollow 10. The coupling according to the present invention may however as an equal alternative encompass a locking portion provided, with respect to the fall, with a transverse shaft (configured as a T) encompassing rollers or bearings arranged on both sides of the T. The receiving portion incl. hollow will under such embodiment be configured for receiving the T incl. rollers or bearings, where the abovementioned slide will be replaced by rolling whereby wear of the components of the coupling is significantly reduced.

The material making up the coupling may be selected such that the coupling expel sufficient strength while at the same time preventing the locking portion 25 from becoming stuck inside the hollow 10 due to verdigris and rust etc.

Although the employment of the coupling according to the present invention finds its primary use within launching systems for boats such as davit launched or free fall life boats, the inventive coupling may equally be applied to tender boats, MOB boats, rescue boats as well as general cargo handling.

The invention claimed is:

1. A coupling for coupling a fall or a structure to a lifeboat, said coupling inter alia comprising a load bearing locking portion adapted to be joined with a fall or a structure and a receiving portion prepared for being attached to, or unified with, a lifeboat, said receiving portion comprising:

a hollow having an open end and being adapted to receive said locking portion, an aperture provided in a wall of said hollow allowing said locking portion to connect with a fall or a structure through said aperture, a width of said aperture is selected such that said locking portion is prevented from passing through said aperture, a pawl, arranged near said open end of said hollow, said pawl being configured such that said pawl allows said locking portion to enter said hollow and, upon entrance of said locking portion into said hollow, prevents said locking portion from exiting said hollow, said pawl is rotatable about an axis whereby said pawl, as a result of rotation, permits said locking portion to enter said hollow, means for, in order to release said coupling, forcing said locking portion out of said hollow, said means for forcing said locking portion out of said hollow inter alia constitute an actuator arranged opposite said open end of said hollow and configured such that said actuator, upon activation, applies a substantially linear force onto said locking portion in a direction oriented outwards of said hollow, wherein said actuator, by means of interconnection, further is configured to change a position of said pawl, such that said locking portion is allowed to exit said hollow, and in that that said pawl is rotated through an arrangement inter alia comprising a glider configured for transferring a linear motion, established by said actuator, from said actuator to said pawl, such that, upon actuation of said actuator, said pawl is rotated about said axis and into a position where said locking portion may exit said hollow.

2. A coupling according to claim 1, wherein a said glider constitutes an angular part with a first flange connected to said actuator and a second flange abutting said pawl.

3. A coupling according to claim 2, wherein said locking portion is, upon receipt of said locking portion into said hollow, accommodated within flanges of said glider.

4. A coupling according to claim 1, wherein said actuator is provided with a return spring.

5. A coupling according to claim 1, wherein said actuator is hydraulically operated.

6. A coupling according to claim 1, wherein said coupling comprise a second actuator.

7. A coupling according to claim 1, wherein said locking portion has a generically spherical shape.

8. A coupling according to claim 1, wherein said coupling further comprises at least one string connected to said locking portion allowing easy retrieval of said locking portion into said hollow by pulling said string.

9. A coupling according to claim 1, wherein inner sides or surfaces of said hollow constitute an elongated funnel.

10. A coupling according to claim 1, wherein said walls defining said hollow constitute a load bearing member transferring loads to said load bearing locking portion.

11. A coupling according to claim 1, further comprising walls defining said hollow having a form preventing said locking portion from passing through said aperture.

12. A coupling according to claim 1, wherein said hollow constitutes a rigid structure with fixed walls ensuring that the width of said aperture is substantially permanent.

13. A coupling according to claim 1, wherein at least a part of a surface of said locking portion is provided with friction reducing means.

14. A coupling according to claim 1, wherein said hollow, on at least on a part of its internal surfaces, is provided with friction reducing means.

15. A coupling according to claim 1, wherein said coupling constitutes an on-load release coupling.

16. A lifeboat comprising a coupling according to claim 1.

17. The lifeboat according to claim 16, wherein said lifeboat further comprises two opposed receiving portions, one being arranged forward of said lifeboat, with said open end of said hollow oriented forward with respect to said lifeboat and one being arranged aft of said lifeboat, with said open end of said hollow oriented aft with respect to said lifeboat.

18. The lifeboat according to claim 16, wherein said apertures are upwardly oriented with respect to said lifeboat.

19. The lifeboat according to claim 16, wherein said coupling is retrofitted onto said lifeboat.

20. The lifeboat according to claim 16, wherein said lifeboat is a freefall lifeboat.

21. A lifeboat coupling system comprising a coupling according to claim 1.

* * * * *

UNITED STATES PATENT AND TRADEMARK OFFICE

CERTIFICATE OF CORRECTION

PATENT NO. : 8,667,921 B2
APPLICATION NO. : 13/378526
DATED : March 11, 2014
INVENTOR(S) : Bent Nielsen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 154 days.

Signed and Sealed this
Twenty-ninth Day of September, 2015

Michelle K. Lee

Michelle K. Lee
*Director of the United States Patent and Trademark Office*